United States Patent [19]

Inose et al.

[11] 4,064,983

[45] Dec. 27, 1977

[54] JAPANESE CHARACTER WORD PROCESSING SYSTEM

[75] Inventors: Fumiyuki Inose, San Jose; Don Winston Geri, Palo Alto, both of Calif.

[73] Assignee: Hitachi, Ltd., Tokyo, Japan

[21] Appl. No.: 710,716

[22] Filed: Aug. 2, 1976

[51] Int. Cl.[2] ..... B41J 1/02; B41J 3/50

[52] U.S. Cl. ..... 197/1 A; 197/19; 197/58

[58] Field of Search ..... 197/1 A, 1 R, 19, 20, 197/56, 58; 178/27; 340/172.5

[56] References Cited

U.S. PATENT DOCUMENTS

| | | | |
|---|---|---|---|
| 306,295 | 10/1884 | Tilton | 197/58 |
| 1,297,020 | 3/1919 | Shinozawa | 197/1 A |
| 3,809,203 | 5/1974 | Ogawa et al. | 197/1 A |
| 3,942,619 | 3/1976 | Nordstrom et al. | 197/1 R |

FOREIGN PATENT DOCUMENTS

| | | | |
|---|---|---|---|
| 382,312 | 8/1973 | U.S.S.R. | 197/56 |

*Primary Examiner*—Paul T. Sewell
*Attorney, Agent, or Firm*—Harold L. Jackson; Stanley R. Jones; Joseph W. Price

[57] ABSTRACT

A word processing system capable of encoding or printing a large number of characters is provided. The present invention is particularly valuable in the encoding and printing of a large number of characters in a foreign language such as Japanese Kanji, and the like. The word processing system will respond to either local switch control or computer generated printing commands. A font storage tray can be operatively connected with optical readers or the like to encode X-Y character positions for storage. The word processing system is easily convertible from a manual typewriter operation to an automatic printer operation. In the manual or encoding mode of operation a removable stylus is utilized in a panographic manner for selecting and positioning the font characters for respectively, loading and printing as a typewriter, or coordinating the combination of optical read codes to store or generate X and Y positions. When converting the word processing system to an automatic printer responsive to computer printing commands a pair of X and Y positional lead screw connectors, connect the storage font tray to appropriate motor drives. The removable stylus character indicator can also be removed from the font storage tray if desirable. Finally, an operatonal mode switch is utilized to disconnect all local operator controls and to initiate a zero position search sequence to provide an absolute reference to enable the word processing system to respond correctly to automatic control.

16 Claims, 7 Drawing Figures

JAPANESE CHARACTER WORD PROCESSING SYSTEM

BACKGROUND OF THE INVENTION

1. Field of the Invention

Present invention is directed to a word processing system and more particularly to a printer and encoding unit capable of handling a large number of characters such as the symbols of the Japanese or Chinese language.

2. Description of the Prior Art

The Japanese written language has been basically derived from Kanji Chinese characters and today three forms of writing are frequently utilized in Japan. These include a normal written form of a Japanese like alphabet having approximately 46 simple symbols and 25 variations called Hiragana, supplementing the Hiragana form of printing is another written character system called Katakana which is basically a phonetic forming of words in writing. Both of these types of Kana have evolved from the basic Kanji symbols and now exist as separate symbols themselves. With certain exceptions, the use of Katakana in the Japanese written writing system is limited to those names or words that are foreign in origin. In modern day Japan, there has been increasing trends of using foreign words.

The Kanji characters are relatively intricate and are generally used to convey meanings as opposed to being used merely as phonetic symbols. Since each symbol can convey a word or a phrase to the reader, a person versed in the Japanese written language must have a knowledge of symbols running into the thousands. Approximately a minimum of 2,000 Kanji characters are required as a vocabulary of written characters for a printer or typewriter. The printer also must include the Kana and especially the Katakana symbols since a written document in Japanese will integrate all three styles of writing.

As can be readily appreciated, the net effect of this relatively sophisticated and complex form of writing is to create relatively complex problems in providing a modern day word processing system. The mere number of characters that must be provided by individual font type creates storage, retrieval, alignment and encoding problems. In addition to the Japanese characters, there is a requirement for additional symbols such as numbers, etc., so that the resultant total number of individual characters required approaches 2,200.

To date, an economical Japanese character word processing system is not available. Japanese character typewriters are known and generally utilized a movable tray of type font that is individually selected in a panographic manner with a selecting stylus. The large number of characters required in the Japanese language has necessitated a relatively complicated mechanical linkage system which is manually operated by the typist. In an attempt to automize a Japanese character typewriter, there has been suggestions to use an impact style printer which employs individual characters on a character drum. However, problems exist with the use of a character drum relating to the complicated control mechanism required for a drum containing such a large number of characters. In addition there are always the problems of obtaining high printing speed with sufficiently high quality print.

At the present date, there are no known serial Japanese character printers suitable for the commercial market with satisfactory print quality and printing speed, nor at the present time has there been provided a sophisticated word processing system to meet the increasing demands of the scientific and industrial fields.

As can be appreciated, serial printers are available in English, which by comparison requires only a limited number of character symbols to adequately convey the written English language. For example, high quality print has been obtained with word processing systems in the United States which includes a serial printer having a character ball, drum or character wheel such as disclosed in U.S. Pat. No. 3,913,722. Other examples of typewriters and printers can be found in U.S. Pat. No. 3,904,015, U.S. Pat. No. 3,890,894, U.S. Pat. No. 3,892,303 and U.S. Pat. No. 3,554,347.

In summary, word processing systems providing a high-speed, high quality print has been achieved with printers having a limited character writing system. To date, there are no known serial Kanji printers having a suitable cost for the commercial market with satisfactory printing quality and printing speed. As a result, when it is required to print Japanese characters, generally, Hiragana and Katakana must be resorted to and Kanji will only be utilized where necessary with a resulting increase in cost reduction and speed. Obviously this limitation seriously impedes the utilization of an intricate and sophisticated written language system in the modern commercial world.

SUMMARY OF THE INVENTION

The present invention provides a total word processing system which includes a serial printer having capability, print quality and costs comparable to that of an alphabetic or Japanese syllabus printer commercially available. The printer assembly of the present invention is capable of storing and printing a large number of characters on a medium from a plurality of individual character fonts that can be automatically positioned adjacent a hammer load station from a movable storage tray. The loading of the hammer, the movement of the carriage for return, forward tab, backspace and platen rotation will be automatically controlled and coordinated in either a semi-automatic operator controlled or a fully automatic computer or microprocessor controlled mode of operation.

A tabular chart provides an array of character positions for operator selection. A movable font storage tray holds individual font characters and is constrained to an X-Y directional movement by appropriate guide ways. A stylus member is removably connected to the storage tray and coordinately positions the storage tray with the assistance of the tabular chart in a manual mode of operation to align the appropriately stylus selected character font over the load station of the hammer assembly. Companion lead screws are connected through a quick disconnect connector assembly with the storage tray for automatic positioning.

In order to use the printer as an encoder or input source for a computer entry, linear position indicators are mounted for coordinate movement with the storage tray and will output an appropriate digital word to indicate an individual character font coordinate position. The same linear position indicators, which can be optical encoders, can be used to initialize the X-Y movement of the storage tray when entering the automatic mode from a start-up or manual operation. For example, an electrical command for local or manual control could cause the storage tray to be driven to the center of the lead screws and than de-energized. Likewise, electrical command for automatic control can cause the tray to be driven to an absolute reference point. The electronic interface for the word processing system in an automatic operation need only require a 12-bit word instruction command and a strobe pulse from a controller. The instruction command is set up in an input register and transferred to three decoders. The decoders will establish the X-Y position of the storage tray as well as the carriage commands. All commands will be routed through a sequencer that can establish the sequence of operation and duration of timed operations.

For use as an encoder, the linear position indicators can generate a 12-bit word that is identical to the input command when the printer is in manual operation. In this mode of operation the actuation of a hammer strike function by the operator could be utilized to set up a data flag to transmit the storage tray position to the memory of the computer. The actual position of the storage tray can be sensed by an encoding wheel that can have a plurality of pulses, $\theta$, per font position and can be mechanically or optically coupled to the motor. The information from this encoder can generate a 10-bit word, in the case of the X axis, and a 9-bit word, in the case of the Y axis, that can indicate the storage tray position. A 10-bit subtractor can compare the command position to the actual position in the automatic mode and generate an error signal including both magnitude and polarity. A digital to analog converter can generate an error voltage proportional to the input error signal and a bidirectional power amplifier can be controlled in level by the error voltage and in polarity by the sign bit from the subtractor. Velocity information can be derived from the shaft position encoder and this information can be utilized as a feedback to stabilize the servo loop as a damping factor. When the servo is moved to eliminate the error voltage, a zero voltage sense circuit can generate a position correct command to the sequencer to partially enable the hammer actuate logic.

While various forms of character printing members could be utilized in the word processing system of the present invention, it is clear that the preferred embodiment is designed to meet the problems encountered with the complex Japanese writing system of Kanji, Hiragana and Katakana symbols plus the normal numerical and other characters required for this language.

The features of the present invention are believed to be novel where set forth particularity in the appended claims. The present invention, both as to its organization and manner of operation, together with further objects and advantages thereof, may best be understood by reference to the following description, taken in conjunction with accompanying drawings.

DESCRIPTION OF THE PREFERRED EMBODIMENT

The following description is provided to enable any person skilled in the word processing and computer art to make and use the invention and it sets forth the best mode contemplated by the inventors of carrying out their invention. Various modifications, however, will remain readily apparent to those skilled in the above art, since the generic principals of the present invention has been defined herein specifically to provide a relatively economical and easily manufactured word processing system to solve the problems of a numerous and complex character writing system.

Figure 1:
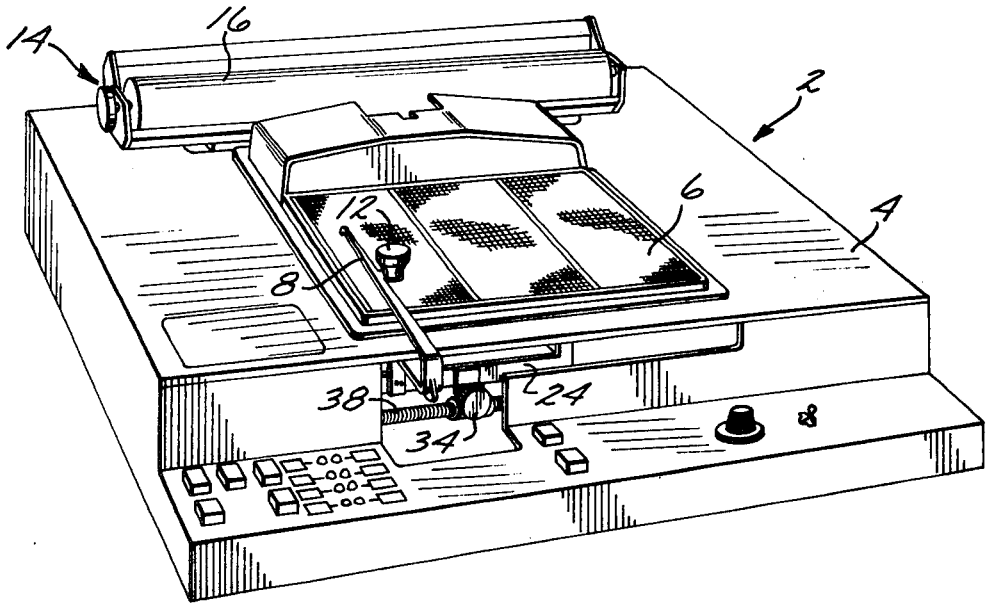
FIG. 1 is a perspective of the printer assembly of the present invention.

Referring to FIG. 1, the printer or typewriter 2 of the word processing system is disclosed in a perspective view. Mounted on the housing 4 is a tabular chart or array 6 representing the total character capability of the typewriter 2. A stylus 8 is removably attached to a font storage tray 10. The stylus further carries an operating knob 12 that permits manual manipulation of the stylus 8 to select an individual character from the tabular chart 6 and correspondingly to move the storage tray 10 to position the same character font in the storage tray 10 over a hammer load station (not shown). The typewriter 2 further includes a carriage 14 with a roller platen 16. Local controls can be mounted on the housing 4 as disclosed in FIG. 1 for manual control by an operator or a semi-automatic entry mode such as with a joy stick, etc.

Figure 2:
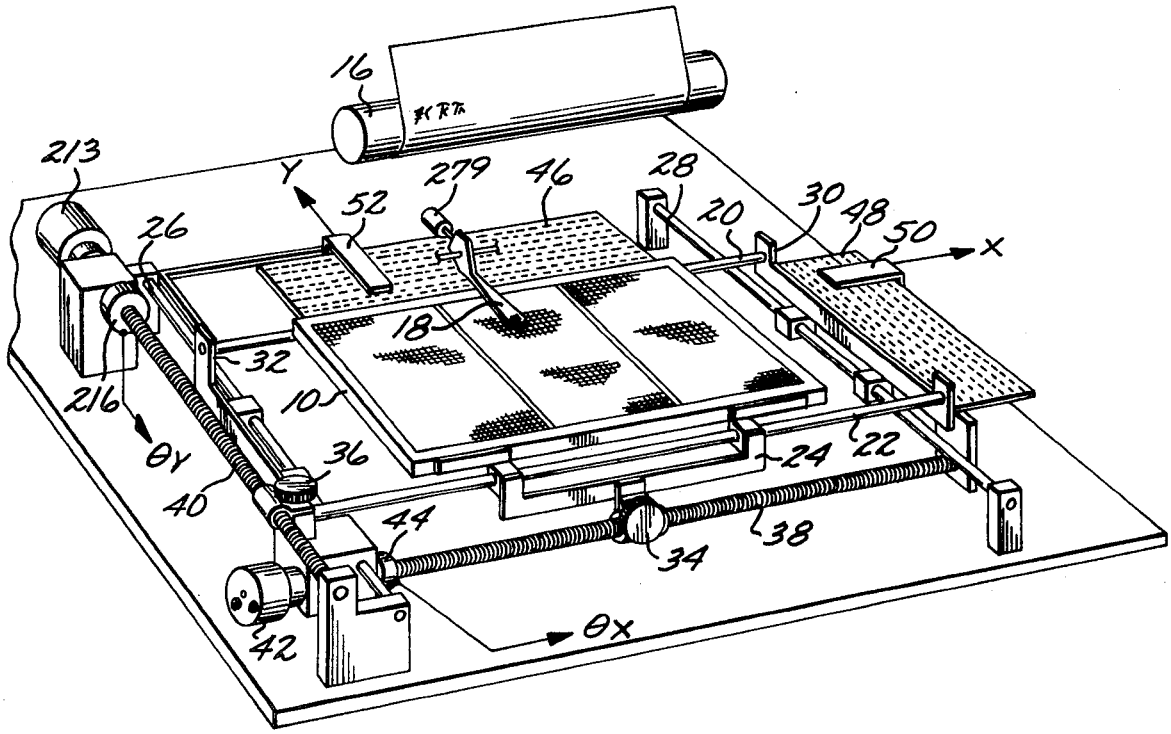
FIG. 2 is a perspective schematic of the storage tray arrangement of the present invention.

Referring to FIG. 2, the storage tray 10 is disclosed and comprises essentially a latice of cavities each holding an individual font character. Approximately 2,200 characters can be positioned on the storage tray 10. Each character cavity is open at the top and bottom to permit the removal and return of an individual character font type. As can be seen in FIG. 2, the striker or hammer 18 helps define a character load station. The hammer end includes an open cavity for receiving an individual font character. The font character carries an appropriate character image on its face and terminates on its other side with an impact surface. Intermediate the font character is an undercut or grooved portion that is adapted to be secured by an appropriate pin or lever as known in the prior art. The hammer assembly 18 has been simplified for purposes of illustration.

Located immediately under the hammer assembly position on FIG. 2, is a font lifter mechanism (not shown) which includes a font lifter solenoid 277 and a spring loaded font lifter pin. The solenoid actuates the font lifter pin to extend upward into a character tray cavity and lift or elevate a font character within the hammer assembly 18. The font lifter pin is spring biased to assist lifter pin removal as well as to decrease solenoid 277 return time when power is removed. Generally the actuation of the font lifter mechanism will be automatic when the striker sequence is initiated. Time sequencing is used to ensure that the font lifter has actuated prior to subsequent hammer assembly actuation. The hammer assembly 18 is driven by a solenoid striker actuator 279. While a solenoid 279 is disclosed in FIG. 2, it should be realized that other actuator means such as a clutched flywheel mechanism could be utilized to provide the necessary energy required for actuation of the hammer assembly. A localized contact switch can be provided on the housing 4 for local control in a semi-automatic manual mode. Each actuation pulse from either the local contact switch or from a remote storage source will result in one font striker sequence.

The font storage tray 10 is mounted on a servo actuated X-Y carriage arrangement. Guiderails or guideways 20 and 22 constrain the movement of the storage tray 10 along an X direction. A bearing mount 24 actually connects the storage tray 10 to the guiderails such as guiderail 22. The stylus 8 can be removably mounted on the bearing mount 24 since it is not needed in an automatic mode of operation.

Guiderails or guideways 26 and 28 constrain the movement of the storage tray 10 along a Y direction. Bearing mounts 30 and 32 support the respective X guiderails 20 and 22 and are connected respectively to the guiderails 28 and 26. A disconnector assembly 34 and 36 interconnects the respective bearing mount 24 and bearing mount 32 with motor driven lead screws 38 and 40 respectively. X lead screw 38 can be driven by an electrical motor 42 while the Y lead screw 40 is driven by electrical motor 213.

Figure 4:
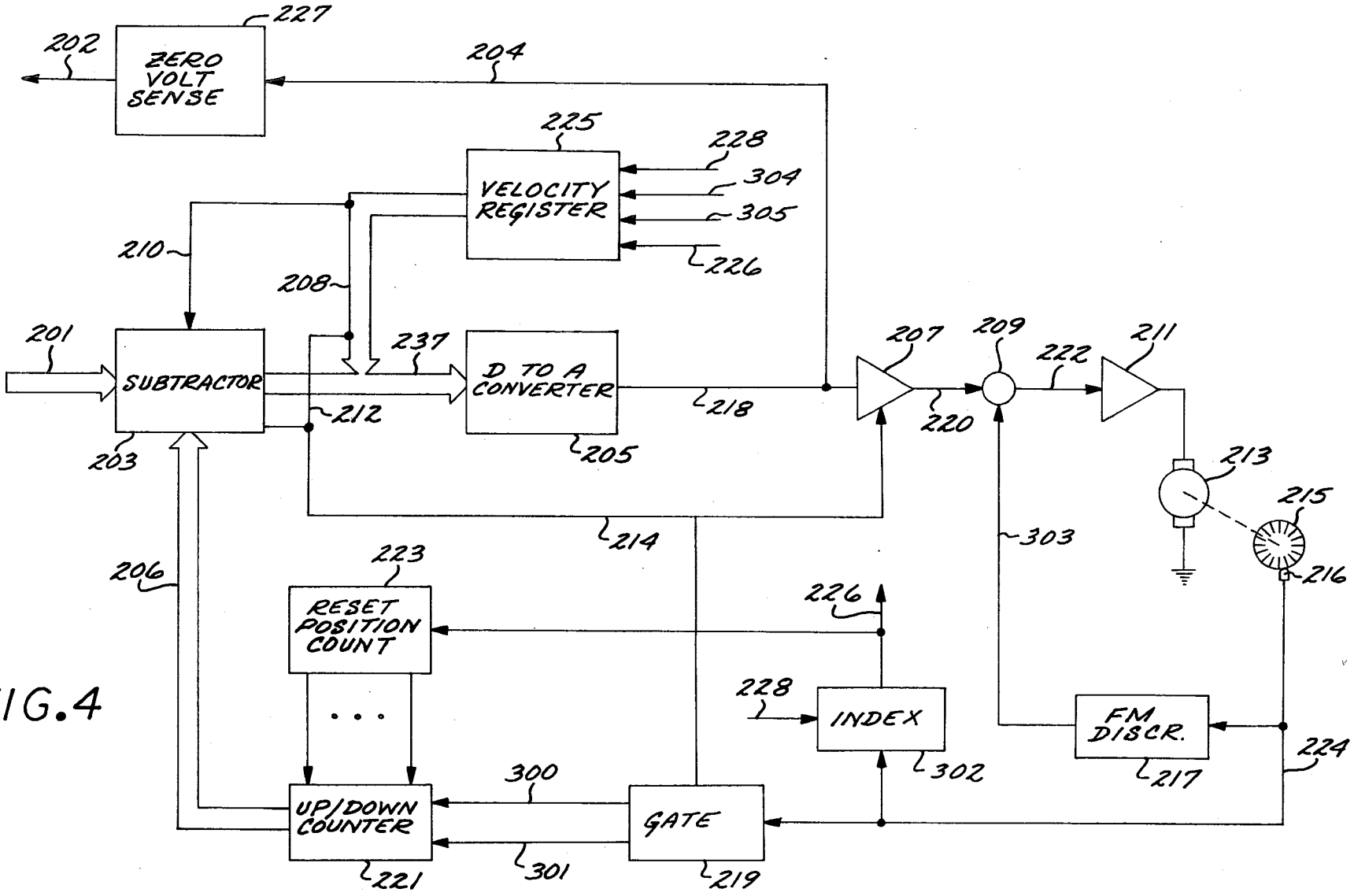
FIG. 4 is a schematic of the servo system.

An encoder wheel 215, best seen in FIG. 4, is connected to each lead screw. An optical sensor 216 adjacent the Y lead screw can cooperate with the encoder wheel 215 to give rotational information, $\theta$, plus clockwise or counterclockwise directional information. An appropriate optical encoder assembly is one manufactured by the Rankco Corporation as a Model KT23A Encoder. A similar encoder assembly 44 is operatively connected with the X lead screw 38.

Connected directly to the character storage tray 10, is a linear position indicator such as an encoder plate 46. The encoder plate carries a series of holes that are coordinated with each X column of characters. Likewise, the bearing mount 30 carries an encoder plate 48 that also carries a series of holes that are individually coded to be representative of each Y column of characters. The respective binary codes indicating an Y and X coordinate position can be sensed by optical position sensors 50 and 52. An appropriate optical sensor and the associated circuitry is manufactured by the Addmaster Corporation and is commercially sold as Model 601 Paper Tape Reader. The Y sensor 50 is mounted stationary relative to the encoder plate 48, while the X sensor 52 is mounted to bearing mount 32 as shown in FIG. 2 for movement therewith.

While not necessary for an understanding of the parameters of the present invention, it should be understood that the carriage roller platen 16 can be rotated by a solenoid through appropriate linkage. Power for the solenoid can be transmitted to the carriage by a slip brush assembly. A localized contact switch can be mounted on the housing 4 to provide for local control in the manual mode of operation. Generally, the automatic carriage return can be accomplished by a rack and pinion drive (not shown). The rack can be attached to the carriage and the pinion can be in constant engagement with the rack and be connected to a drive motor that incorporates a moving armature type clutch disconnect. Again, localized contact switch can be utilized to provide control in a manual mode of operation. Carriage spacing can be accomplished with escapement solenoids or a motor (not shown) to provide both forward tab spacing and backspacing. Again localized contact switches can be utilized to provide operator control in a manual mode.

Figure 3:
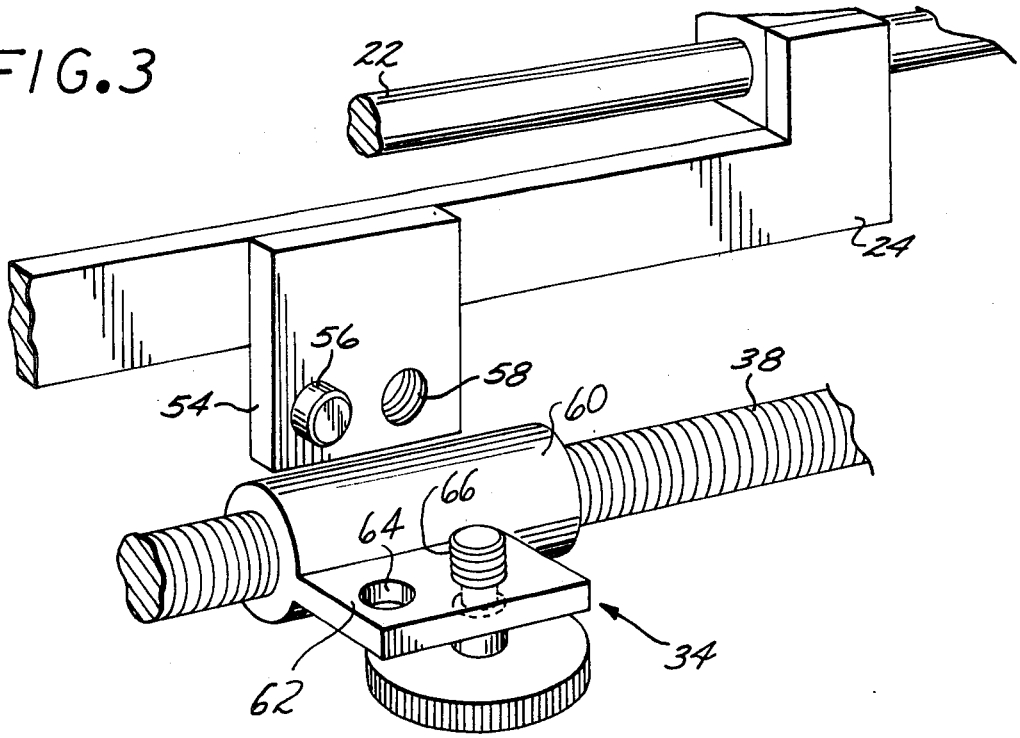
FIG. 3 is a perspective view of a quick disconnect assembly.

Referring to FIG. 3, a perspective view of a disconnect connector assembly such as 34, is shown. A bearing mount plate 54 has a precision alignment pin 56 protruding from its front surface. A threaded bore 58 is also provided on the plate 54. A lead screw nut 60 carries a mounting plate 62 with an indexing bore 64 and a threaded shaft 66.

FIG. 3 discloses connector assembly in the manual mode of operation when the storage tray 10 is released from the drive screws 38 and 40. In an automatic mode of operation the alignment pin 56 is positioned within the index bore 64 and the threaded shaft 66 engages the threaded bore 58 to permit the bearing mount 24 to be driven by the lead screw 38. The other disconnect connector assembly 36 is similar to the connector assembly 34 disclosed in FIG. 3.

In the manual operation mode wherein the operator selects the characters to be printed with the selector or stylus arm 8 the typewriter of the present invention senses a binary code generated by the linear X and Y axis position sensors 52 and 50, respectively. The X and Y code is supplied over trunks 256 and 258 (FIG. 5) to X, Y position register 233. The length of the binary codes generated by the linear X, Y position sensors 52 and 50, respectively will be determined by the number of X positions and Y positions on the character table. The X and Y position codes stored in register 233 identifies a particular font character on the character table. Upon the sequencer 265 (FIG. 6) generating a strike enable signal on line 230, position register 233 transfers its X and Y codes over trunk 260 and 262, respectively to the computer. In this manner the typewriter functions as a computer input device.

Obviously, it is a simple matter to provide for this computer input function without also requiring the typewriter to print. Likewise, if the computer input function is not desired, the command signal generated by the sequencer 265 on line 230 may be disabled. Both of these alternative functions can be accomplished by well-known selection switches (not shown) on the control panel.

In the automatic mode wherein the typewriter is being driven by a computer which is either located at a remote or local site, the servo systems of the typewriter are engaged. FIG. 4 illustrates one of the two servo systems utilized, one servo system being used for each axis of movement for the character table. Assume for the sake of example that the servo loop of FIG. 4 serves the X axis. Thus, motor 213 positions the character table on the X axis.

Attached to the shaft of motor 213 is an encoder wheel 215 which is optically sensed by device 216. The encoder wheel a and its cooperating optical sensor 216 provide X axis position and shaft velocity indication on line 224. The velocity discriminator 217 detects the velocity component of the signal on line 224. Gate 219 detects the position component of the signal on line 224.

The encoder wheel 215 has an index position thereon which is sensed by optical sensing device 216, said index signal is detected by index code sensor 302 which generates an index mark signal on line 226 in response thereto. The index code detector is operative only when enabled by a signal on line 228.

The signals generated by the optical tachometer, made up of encoder wheel 215 and optical detector 216, is utilized to index up/down counter 221. The direction that the counter 221 is driven depends upon which input line 300, or 301, the increment signal is received by the counter. Line 300 is the up-count line, line 301 is the down-count count line. Gate 219 determines the direction that counter 221 is being incremented with basis of the signal received by it on line 214 from the binary subtractor unit 203. The signal on line 214 can be characterized as a sign or direction signal. For example, a positive sign may mean a first direction of movement of the character table along the X axis, while a negative sign may mean a second direction of movement of the character table. Thus, if the motor is driving in a clockwise direction, which is related to the first direction of table movement, the gate would route the incrementing signals to the counter 221 on line 300 thereby driving the counter 221 to increase its binary count. On the other hand if the motor is driving in a counter clockwise direction, the sign signal on line 214 would cause the up-down counter 221 by way of gate 219 to be increment in a negative direction. The contents of the up-down counter 221 in any instant of time is supplied over trunk 206 to the binary subtractor unit 203.

Subtractor unit 203 forms the difference of the binary information received on trunk 206 and the binary information received on trunk 210. The binary information received on trunk 201 represents the position information supplied by the computer. The difference between these two received binary words represent a binary error signal which is supplied on trunk 237 to a digital-to-analog converter 205. This error signal may be in a positive or in a negative direction. Thereby, subtractor unit 203 also generates a direction signal on line 214. The digital-to-analog converter 205 converts the binary information received on trunk 237 to an analog amplitude signal on line 218. The polarity of this signal is modified, if required, in amplifier 207 according to the information on line 214.

This amplitude signal is also supplied to a zero voltage sensor device 227 by way of line 204. If a zero voltage is sensed by device 227, an output signal is generated on line 202 to indicate that the servo has driven the table to the correct position on that axis.

However, assuming that an error signal is present on line 218, that error signal is modified in direction by amplifier 207 according to the signal on line 214. The output of amplifier 207 is supplied on line 220 to summing circuit 209. The other signal received by summing circuit 209 on line 303 represents the damping factor generated by velocity discriminator unit 217. This damping loop is utilized to stabilize the servo loop. The damped error signal on line 222 is then fed through amplifier 211 to the driving circuit of motor 213, causing it to drive in the direction commanded by the output of amplifier 211.

The velocity register 225, the reset position count register 223, as well as the index code sensor 302 are utilized during an initializing sequence which will be explained subsequently.

Figure 5:
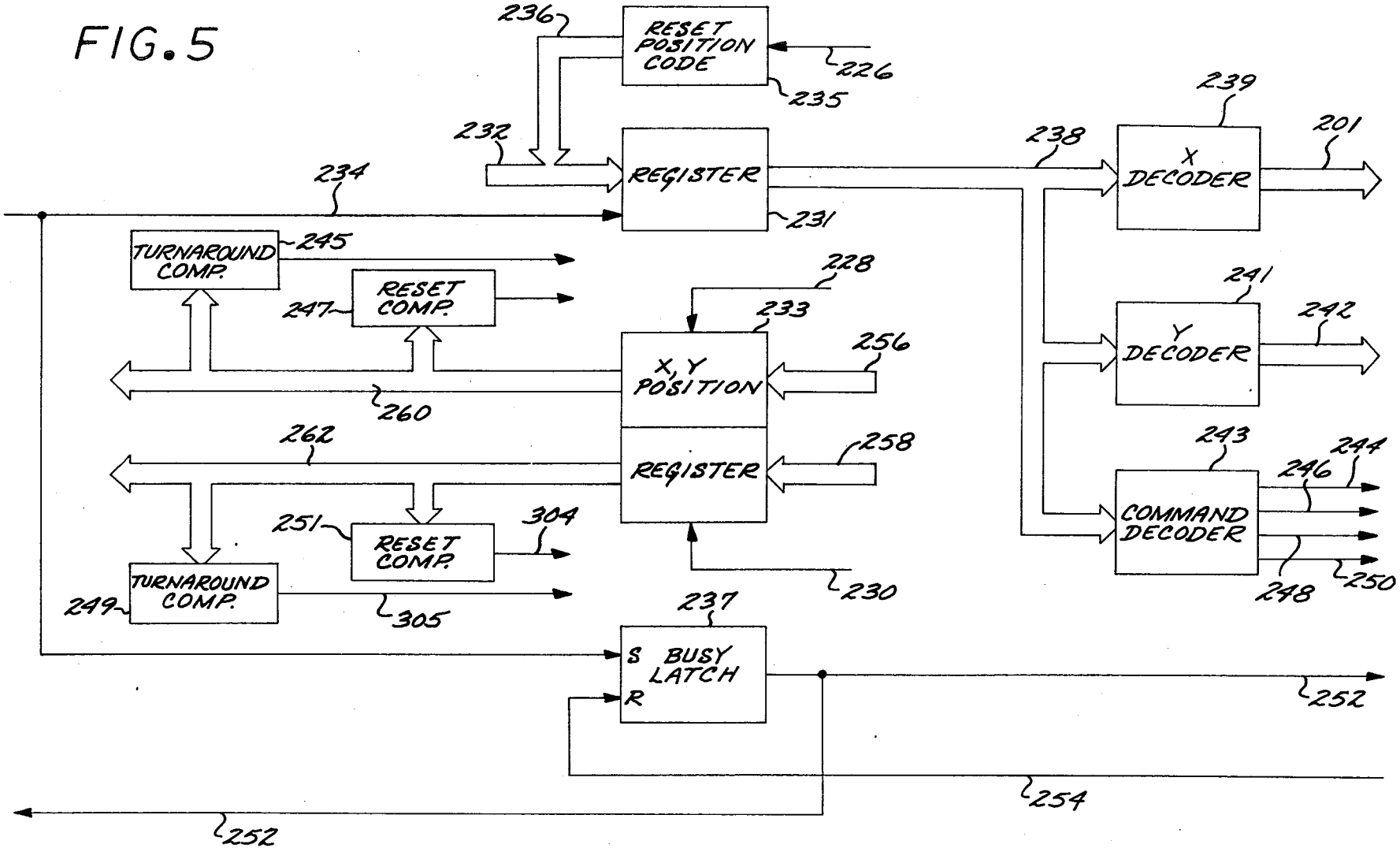
FIG. 5 is a decoder controlled system block diagram.
Figure 6:
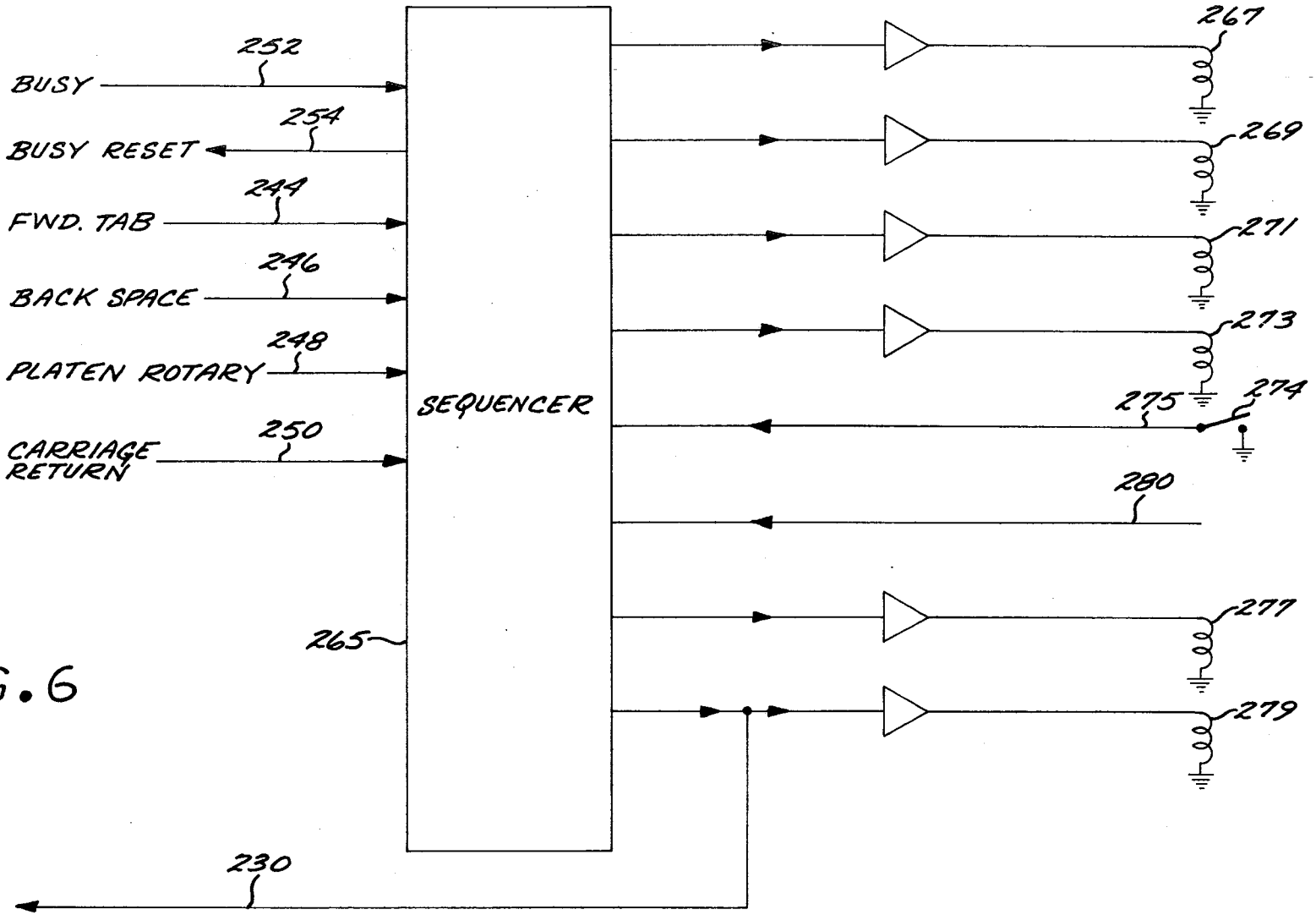
FIG. 6 is a block diagram of the code sequencer controls of the present invention.

The X position code on trunk 201 is received from an X decoder 239 of the decoder control system of FIG. 5. The decoder control system of FIG. 5 receives a computer command word on trunk line 232 by way of parallel input/output register 231. Upon receipt of the computer command word on trunk line 232 and a command strobe signal on line 234, the action directed by the command word stored in register 231 will be initiated. Upon initiation of a command the busy latch 237 generates a busy status signal on line 252 which is supplied to the computer until the action commanded has been completed as indicated by a signal on line 254, which is generated by sequencer 265 (FIG. 6).

At the same time that a busy signal is sent to the computer on line 252, it is sent to the sequencer 265. This busy signal, when received by the sequencer 265 will cause it to take certain actions depending on what additional signals are received. If the busy signal on line 252 is received by the sequencer without any additional command signals, the sequencer will initiate a print cycle. Therefore, on indication from both the X and Y servos that the proper position has been reached on both the X and Y directions, the sequencer will first generate a signal to actuate the font lifter solenoid 277 and then the striker actuator solenoid 279. The position correct signal on line 280 provides the indication that proper position has been reached. The position correct signal on line 280 can be generated from the position correct signals generated by the voltage sensing circuits such as voltage sense circuit 227 for the X servo. When both the X and Y position correct signals are present as detected by an AND gate (not shown) the font table is located correctly both in the X and Y direction. At this time the AND gate would generate a table position correct signal on line 280.

The computer command word received on channel 232 by the register 231 may be either an X position or Y position indicating word or it may be a word commanding the generation of one of the operations, such as forward, tab, back space, platen rotate, or carriage return. X decoder 239 and Y decoder 241 and command decoder 243 recognize the command words that are directed for their use and respond accordingly. If the computer commands one of the functions decoded by command decoder 243, for example, a forward tab, a signal is generated on command line 244. Such command signal is supplied by the decoder to the sequencer 265. If at the same time, the sequencer is receiving a busy signal on line 252, the sequencer will generate a signal to the forward tab solenoid 267. This signal is in the form of a pulse. The length of the pulse indicates the length of time that that solenoid is to be actuated.

If, for example, a carriage return command was supplied on line 250 by decoder 243 to the sequencer 265, the sequencer 265 would generate a power signal to the carriage return motor 273 until the carriage return limit switch 274 was tripped causing a signal on line 275 to be supplied to the sequencer 265. This signal would cause the sequencer to terminate the power signal to the carriage return motor 273.

Upon an operation being completed, the sequencer 265 generates a busy reset signal on line 254 which is supplied to busy latch 237 of the decoder controller (FIG. 5). This terminates the busy indication to the computer on line 252 permitting it to send another command to the controller.

The turnaround comparator circuit 245 for the X axis position and the turnaround comparator cirucit 249 for the Y axis position, as well as the reset comparator circuit 247 for the X axis position and the reset comparator circuit 251 for the Y axis position, along with the reset position code register 235 are utilized during the initializing cycle. This initializing cycle is used to position the character table at a convenient null point at the start of the automatic mode, whether it be from start-up or when switching between the manual and automatic mode.

The operation of the typewriter in the initializing mode will be explained in conjunction with the Flow Chart of FIG. 7 and the structure of FIGS. 4 and 5. It should be understood again that the system utilizes two servos of the type shown in FIG. 4, whereby the controller of FIG. 5 is supplying signals to two servo systems. For the purposes of simplicity of explanation only one such servo system will be discussed.

Upon start up or when switching from manual to the automatic mode, which can be controlled by power switches on the control panel of the typewriter, an initiate reset signal is generated and supplied on line 228 to the velocity register 225, to X, Y position register 233 and to index code detector 302. This initiate reset signal causes velocity register 225 to disable, by way of a signal on line 210, subtractor unit 203 and dump by way of trunk 208, a binary velocity signal into digital-to-analog converter 205. Along with the signal to digital-to-analog converter 205, a sign or direction indicating signal on line 212 is supplied to amplifier 207. The signal on line 228 also enables X, Y position register 233 to receive, over trunks 256 and 258, and transmit over trunks 260 and 262, the X, Y position indications generated by the linear optical position sensors 50 and 52 (FIG. 2).

Figure 7:
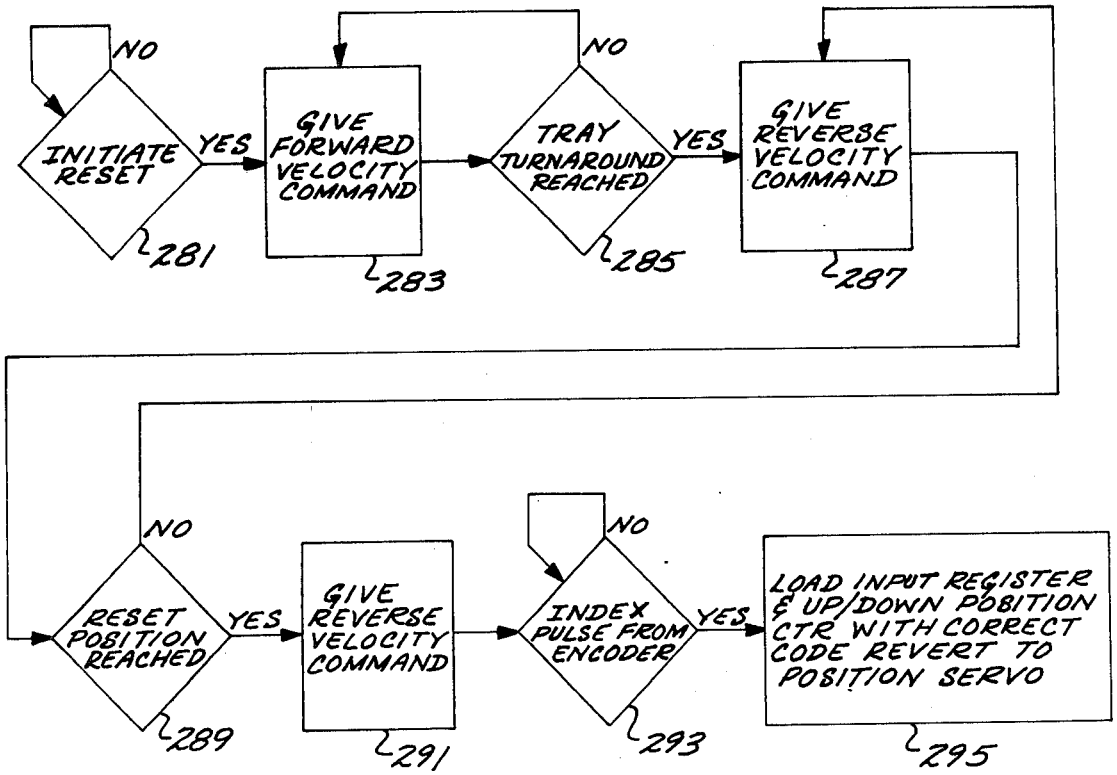
FIG. 7 is a positional control flow chart of the present invention.

Looking at the Flow Chart of FIG. 7, as the result of an initiate reset signal being received, the answer to that decision 281 is "yes" and a forward velocity command 283 is generated. Velocity register 225 provides this forward velocity signal, in an open-loop fashion to digital-to-analog converter 205. This forward velocity signal is supplied to the motor and drives the motor 213 until the character table has reached a position on the X axis that has been predetermined to be a position that is beyond the home or reset position on that axis. Thus, if the table was being driven toward the reset position, which would depend on its starting point, such position would have been detected by the reset comparator 251. If such is the case, the 285 decision and 287 command would be skipped. However, assume that such is not the case. The turnaround position is detected by the turnaround comparators 245 and 249, turnaround comparator 249 being for the Y axis. Upon the turnaround comparator 249 sensing the turnaround point it generates a signal on line 305 that is supplied to velocity register 225 causing the direction indication signal on line 212 to change which will drive the motor 213 in an open loop manner in the opposite direction. The turnaround decision 285 of FIG. 7 having been made, a reverse velocity command 287 is issued. The table will therefore be driven in the opposite direction until the reset home position is sensed by reset comparator circuit 251. Upon sensing the reset position the comparator generates a signal on line 304 that again causes the velocity register 225 to change the direction indication signal on line 212 thereby again providing a reversing signal to the motor 213. This is exemplified by the decision 289 in FIG. 7 being made and causing a reverse velocity command 291 to be issued. The reversing of the drive motor 213 is utilized to quickly brake the motor and table at the reset position. It must be remembered it is being driven in an open loop manner. The optical encoder 216 on the shaft on the motor will generate its index signal which is detected by index detector 302. The index detector 302 will generate a signal on line 226 to enable position count register 223, disable velocity register 225 and enable position code register 235.

The decision 295 that the index pulse occurred, as shown in FIG. 7, causes certain information to be loaded into the counter 221 and the input register 231. By disabling velocity register 225, the subtractor 203 is again enabled, thereby returning the system to a closed loop servo. The input register 231 is loaded with a binary word, the contents of register 235, that indicates the X reset position of the table. The up-down counter 221 is loaded with the contents of register 223, that is an appropriate count indicating the reset position of the table.

In summary what has been disclosed is a word processing system capable of encoding a priority, a larger number of characters in a foreign language such as Japanese, Kangi, or the like. The word processing system will respond to either local manual control or computer generated commands. The word processing system is easily convertible from manual or typewritten operation to automatic printer operation. It should be understood, that the foregoing disclosure relates only to a preferred embodiment of the invention and numerous modification may be made therein without departing from the spirit and scope of the invention as set forth in the appended claims.

What is claimed is:

1. An automatic word processing printer system for use with a large number of characters comprising:

a movable font storage means for storing individual font characters;

support means for movably mounting the storage means including an X-directional guideway and a Y-directional guideway, said X-directional guideway movably supporting said font storage means and said Y-directional guideway movably supporting said X-directional guideway and said font storage means;

a hammer assembly for receiving a font from the storage means and impacting it against an appropriate medium;

first motor means for driving the font storage means along the X axis and Y axis guideways relative to the hammer assembly;

control means for driving the first motor means to a predetermined font character;

monitor means for generating a hammer fire signal when the predetermined font character is aligned with the hammer assembly;

second motor means for actuating the hammer assembly when a hammer fire signal is generated;

first encoder means for generating an X direction positional signal of an individual font character; and second encoder means for generating a Y direction positional signal of said individual font character, said first and second encoder means comprise one encoder plate member and a sensor member mounted adjacent the encoder plate member, the encoder plate member of said first encoder means is mounted to said font storage means for movement therewith, and wherein the sensor member of said first encoder means is mounted to said Y-directional guideway for movement therealong.

2. The invention of claim 1 further including tabular means for providing an index of character positions and a removable stylus member connected to the font storage means.

3. The invention of claim 1 wherein the encoder plate member of said second encoder means is mounted to said Y-directional guideways for movement therealong.

4. The invention of claim 3 wherein the encoder sensor member of said second means is mounted to be stationary with respect to the second encoder plate member.

5. The automatic word processing system of claim 1 wherein said first motor means comprise:

a motor means for driving said font storage means along an X direction; and a motor means for driving said font storage means along a Y direction perpendicular to said X direction.

6. The word processing system of claim 5 wherein said X direction motor means includes a first leadscrew and said Y direction motor means includes a second leadscrew.

7. The automatic word processing system of claim 6 wherein said X direction motor means includes first means for drivably connecting said first leadscrew to said font storage means and said Y direction motor means includes second means for drivably connecting said second leadscrew to said font storage means.

8. The automatic word processing system of claim 7 wherein said first and second drivably connecting means comprises means for selectively connecting and disconnecting said drivably connecting means.

9. An automatic typewriter adapted for use with a large number of characters comprising:

tabular chart means for providing an array of character positions;

a movable font storage means for storing the individual font characters;

a stylus member connected to the font storage means and coordinately positioned relative to the tabular means to individually select a character on the tabular means;

print means for printing a font character selected by the stylus member including motor means for actuating a hammer assembly to select and impact a font character;

encoder means for generating a positional signal identifying the font character selected and impacted including first means for generating an X direction positional signal of an individual font character and second means for generating a Y direction positional signal of said individual font character, said first and second means comprise an encoder plate member and sensor member mounted adjacent the encoder plate member, wherein the encoder plate member of said first means is mounted to said font storage means for movement therewith, and wherein the sensor member of said first means is mounted for movement with its encoder plate member in the Y direction and remain stationary with respect to its encoder plate member in the X direction.

10. The automatic typewriter of claim 9 wherein the encoder plate member of said second means is mounted for movement with said font storage means in the Y direction.

11. The automatic typewriter of claim 10 wherein the sensor member of said second means is mounted to be stationary with respect to the second encoder plate member.

12. An automatic Japanese character word processing system for printing at least Kanji, Katakana and Kirakana characters comprising:

a movable tray storage means for storing individual font characters;

a tabular chart providing an array of stored character positions that are coordinately positioned relative to the storage means;

means for selecting an individual character on the tabular chart;

encoder means for optionally generating a positional signal representative of a selected font character;

first motor means for optionally driving the tray storage means including first leadscrew means for driving said font storage means along an X direction and second leadscrew means for driving said font storage means along a Y direction perpendicular to said X direction;

a hammer assembly mounted adjacent the tray storage means for receiving a font character from the storage means and impacting it against an appropriate medium; and a second motor means for automatically actuating the hammer assembly, whereby a character can selectively be encoded into a storage means, imprinted onto a medium, or both encoded and imprinted.

13. The automatic word processing system of claim 12 wherein said X direction motor means includes first means for driveably connecting said first leadscrew to said font storage means and said Y direction motor means includes second means for driveably connecting said second leadscrew to said font storage means.

14. The automatic word processing system of claim 13 wherein said first and second driveably connecting means comprises means for selectively connecting and disconnecting said driveably connecting means.

15. The invention of claim 12 wherein the encoder means includes at least one encoder plate member and a sensor member mounted adjacent the encoder plate member, one of the sensor and plate members being mounted on the font storage means for relative movement to the other member.

16. The invention of claim 12 further including a disconnect assembly for uncoupling the first motor means to permit semi-manual operation selectively as either a typewriter or encoder terminal.

* * * * *

UNITED STATES PATENT AND TRADEMARK OFFICE

CERTIFICATE OF CORRECTION

PATENT NO. : 4,064,983

DATED : December 27, 1977

INVENTOR(S) : Fumiyuki Inose and Winston Geri

It is certified that error appears in the above-identified patent and that said Letters Patent are hereby corrected as shown below:

Col. 7, line 20 - delete "210" and insert --201--.

Col. 12, line 9 - delete "Kirakana" and insert --Hirakana--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*